US007618033B2

(12) United States Patent
Fujita et al.

(10) Patent No.: US 7,618,033 B2
(45) Date of Patent: Nov. 17, 2009

(54) SHEET PROCESSING APPARATUS AND IMAGE FORMING APPARATUS

(75) Inventors: Keiko Fujita, Kashiwa (JP); Hitoshi Kato, Toride (JP); Wataru Kawata, Kashiwa (JP); Youichi Chikugo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 452 days.

(21) Appl. No.: 11/608,131

(22) Filed: Dec. 7, 2006

(65) Prior Publication Data

US 2007/0132169 A1 Jun. 14, 2007

(30) Foreign Application Priority Data

Dec. 9, 2005 (JP) ..... 2005-356550

(51) Int. Cl.
*B65H 37/04* (2006.01)

(52) U.S. Cl. ..... 270/32; 270/37; 270/58.07; 270/45; 270/51; 270/58.11

(58) Field of Classification Search ..... 270/32, 270/37, 45, 51, 58.07, 58.08, 58.09, 58.11, 270/58.12, 58.17; 412/3, 4, 5, 8, 17, 18, 412/19, 21, 22, 33

See application file for complete search history.

(56) References Cited

U.S. PATENT DOCUMENTS

| | | | | |
|---|---|---|---|---|
| 3,706,107 | A * | 12/1972 | Cullen | 412/24 |
| 3,922,743 | A * | 12/1975 | Schuler et al. | 412/1 |
| 4,100,639 | A * | 7/1978 | Dietrich | 412/1 |
| 4,373,844 | A * | 2/1983 | Conroy | 412/24 |
| 6,895,212 | B2 * | 5/2005 | Yamakawa et al. | 399/407 |
| 7,207,557 | B2 * | 4/2007 | Kaneko et al. | 270/58.08 |
| 2003/0214092 | A1 * | 11/2003 | Horii et al. | 270/52.18 |
| 2005/0179190 | A1 * | 8/2005 | Kamiya et al. | 270/58.07 |

FOREIGN PATENT DOCUMENTS

| | | | |
|---|---|---|---|
| EP | 534888 | A1 * | 3/1993 |
| JP | 01-301291 | | 12/1989 |
| JP | 2001-260564 | | 9/2001 |
| JP | 2004-305879 | | 11/2004 |

* cited by examiner

*Primary Examiner*—Gene Crawford
*Assistant Examiner*—Leslie A Nicholson, III
(74) *Attorney, Agent, or Firm*—Canon USA Inc IP Div

(57) ABSTRACT

A sheet processing apparatus for covering a sheet bundle with a cover sheet includes a creasing unit for making a crease along an end portion of the cover sheet adjacent the edge of the sheet bundle opposite the spine edge of the sheet bundle. The sheet processing apparatus further includes a folding-back unit for folding-back the end portion of the cover sheet along the crease made by the creasing unit.

5 Claims, 8 Drawing Sheets

SHEET PROCESSING APPARATUS AND IMAGE FORMING APPARATUS

BACKGROUND OF THE INVENTION

1. Field of the Invention

The present invention relates to a sheet processing apparatus for processing sheets and an image forming apparatus having the sheet processing apparatus.

2. Description of the Related Art

A sheet processing apparatus is usually arranged on a downstream side of an image forming apparatus body, such as a copying machine and a printer, for performing predetermined processing, such as alignment and stapling, on a sheet outputted from the image forming apparatus body to have images formed thereon.

Recently, such sheet processing apparatus has been multi-functionalized, and for example, a sheet processing apparatus may include a side stitching unit by which one side of a sheet bundle made up of the same size sheets is stapled for book binding. In addition, there has been known an apparatus having a saddle stitching unit by which after the center of a sheet bundle made up of the same size sheets is stapled, the sheet bundle is folded back along the stapled position for book binding. Furthermore, as disclosed in Japanese Patent Laid-Open No. 2001-260564, an apparatus is known having a function flattening the curvature of the spine of a sheet bundle saddle stitched and folded. It is also known to bind one side of a sheet bundle with an adhesive such as glue.

On the other hand, color copying machines and color printers have been increasingly used as an image forming apparatus for outputting sheets. It is desirable to provide a more attractive appearance in the sheet bundle resulting from a sheet processing apparatus used in such an image forming apparatus.

However, in the sheet bundle bound with staples as mentioned above, staple wire is exposed on the surface of the sheet bundle, giving an impression in appearance of a simple and unattractive book binding process. Specifically, in the side stitching, on a spine made up of cut edges of sheets, characters or images cannot be recorded. In the saddle stitching, even when a spine is formed by the flattening processing, for example, characters or images recorded on the flattened spine may be hidden behind staple wire.

In order to avoid these disadvantages, a perfect binding method may be employed, in which a sheet bundle is secured with an adhesive instead of staple wire; however, the quality of the appearance may be reduced due to the adhesive. There is also a method, in which a secured sheet bundle is covered with a book cover sheet. However, these methods, such as the perfect binding and the book sheet covering, are generally employed in off-line processing, so that the cost of the product is increased, the apparatus is increased in size, and the operation is complicated. Japanese Patent Laid-Open No. H01-301291 and No. 2004-305879 describe a method for covering a sheet bundle with a book cover sheet, in which the accuracy in folding the sheet bundle along a fore edge of the sheet bundle upon covering the book cover sheet has an influence on the degree of the product appearance. The fore edge of the sheet bundle herein means the open-side edge of the sheet bundle (opposite to the spine). The mechanism for folding the book cover sheet is not described in these Patent Documents.

SUMMARY OF THE INVENTION

The present invention provides a sheet processing apparatus capable of obtaining a resultant product with a more attractive appearance, and also an image forming apparatus having this sheet processing apparatus.

A sheet processing apparatus for covering a sheet bundle with a cover sheet according to the present invention includes a creasing unit for making a crease along the outer shape of one end of the sheet bundle on an end portion of the cover sheet on a far side of the cover sheet portion folded with the other end of the sheet bundle; and a folding-back unit for folding-back the end portion of the cover sheet along the crease made by the creasing unit.

According to the present invention, a resultant product with an attractive appearance can be obtained.

Further features of the present invention will become apparent from the following description of exemplary embodiments with reference to the attached drawings.

DESCRIPTION OF THE EMBODIMENTS

A first embodiment according to the present invention will be exemplarily described in detail below with reference to the drawings. However, dimensions, materials, shapes, and relative arrangements of components according to the embodiment may be appropriately modified according to the configurations and conditions of the apparatus incorporating the invention. Hence, unless otherwise specified, the scope of the invention is not limited to the detailed configuration of the embodiment.

First Embodiment

A sheet processing apparatus and an image forming apparatus according to a first embodiment will be described below with reference to FIGS. 1 to 7.

Figure 7:
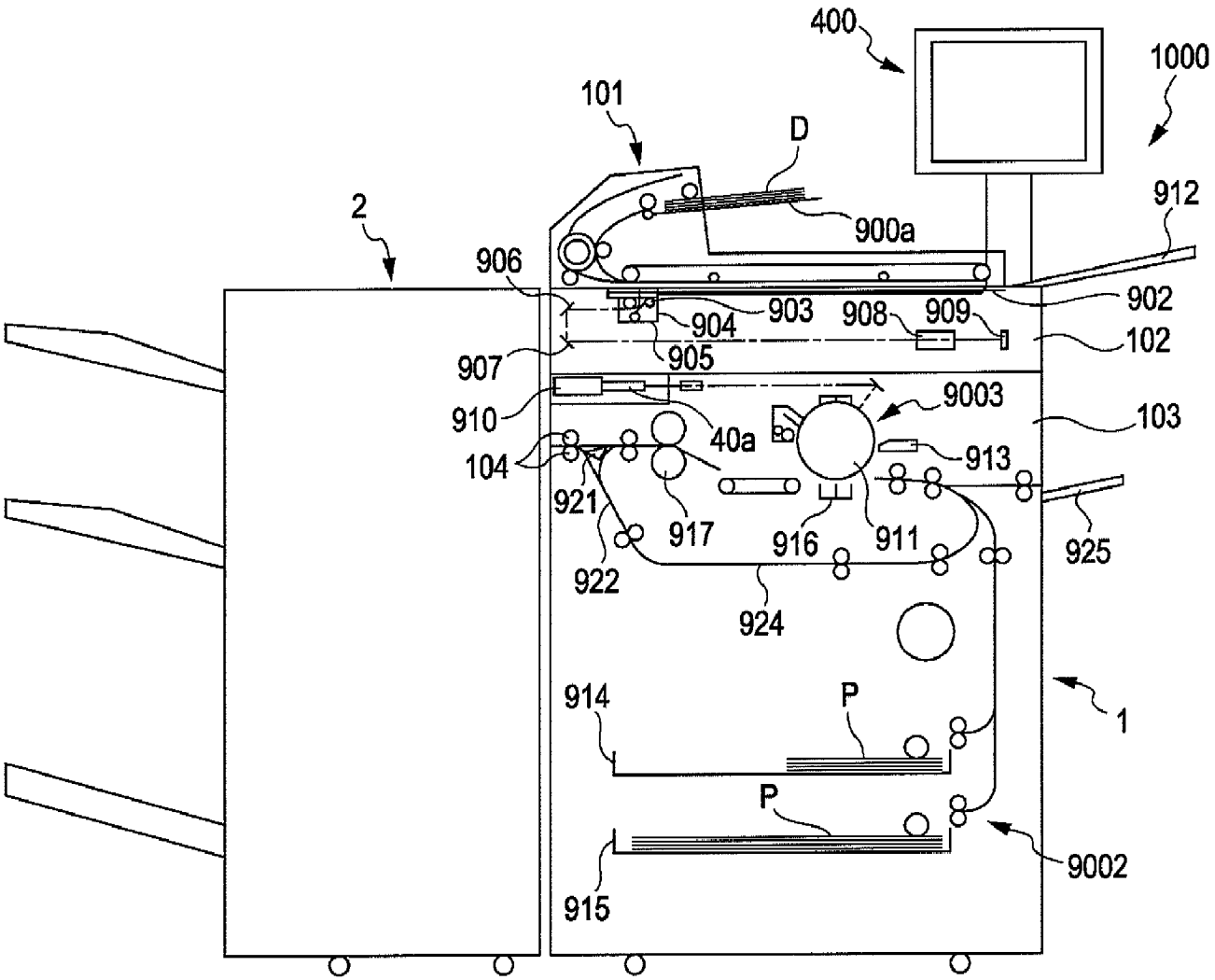
FIG. 7 is a sectional view of the image forming apparatus having the sheet processing apparatus.

FIG. 7 is a sectional view of a copying machine that is an example of an image forming apparatus having a sheet processing apparatus according to the first embodiment of the present invention.

Referring to FIG. 7, a digital copying machine 1000 as an image forming apparatus includes a copying machine body 1 and a finisher 2 as a sheet processing apparatus. The copying machine body 1 includes an image forming apparatus body 103 and a scanner 102 arranged on the upper surface of the image forming apparatus body 103.

The scanner 102 for reading images of a manuscript includes a manuscript feeding unit 101, a scanner unit 904, mirrors 905 to 907, a lens 908, and an image sensor 909. When the scanner 102 reads a manuscript D, the manuscript D is first set on a manuscript tray 900*a* of the manuscript feeding unit 101. At this time, the manuscript D is to be set on the manuscript tray 900*a* in a face-up state in that the surface having images formed thereon is directed upwardly.

After the manuscript D set in such a manner is sequentially fed one sheet at a time from the head page in the left direction by the manuscript feeding unit 101, the manuscript D is conveyed on a platen glass 902 via a curved path from the left to the right, and then it is discharged onto a discharge tray 912.

When images of the manuscript are read while the manuscript is being conveyed in such a manner by the manuscript feeding unit 101, the scanner unit 904 is maintained at a predetermined position. The manuscript D passes over the scanner unit 904 from the left to the right so as to carry out the reading process of the manuscript D.

In this reading process, a light beam from a lamp 903 of the scanner unit 904 impinges upon the manuscript D passing over the platen glass 902, so that the reflected light is guided to the image sensor 909 via the mirrors 905 to 907 and the lens 908. Every line of the manuscript image data read by the image sensor 909 is fed to an exposure control unit 910.

Alternatively, the manuscript D conveyed by the manuscript feeding unit 101 may be stopped on the platen glass 902 so that the manuscript D is read by moving the scanner unit 904 from the left to the right. Furthermore, when reading a manuscript without using the manuscript feeding unit 101, a user raises the manuscript feeding unit 101 and sets the manuscript on the platen glass 902, and then, the manuscript is read.

Within the image forming apparatus body 103 for forming images on a sheet, there are provided a sheet feed unit 9002 for feeding sheets P accommodated in cassettes 914 and 915, and an image forming unit 9003 for forming images on the sheet P fed by the sheet feed unit 9002.

The image forming unit 9003 herein includes a photosensitive drum 911, a developing unit 913, and a transfer charger 916. During image formation, latent images are formed on the photosensitive drum 911 by irradiating a laser beam from the exposure control unit 910 onto the photosensitive drum 911. The latent images are developed into toner images by the developing unit 913. On the downstream side of the image forming unit 9003, a fixing unit 917 and a discharge roller pair 104 are arranged.

An operation display unit 400 is arranged on the upper surface of the copying machine body 1. The operation display unit 400 includes a plurality of keys for setting various functions and a display unit for displaying set-up state information of the apparatus.

The image forming operation of the copying machine body 1 configured in such a manner will now be described.

First, as described above, the image data obtained by reading the manuscript D with the image sensor 909 of the scanner 102 are fed to the exposure control unit 910 after receiving predetermined image processing. Then, the exposure control unit 910 outputs a laser beam according to the image signal.

The laser beam is radiated on the photosensitive drum 911 while the photosensitive drum 911 being scanned with the laser beam using a polygon mirror 910*a*, thereby forming electrostatic latent images on the photosensitive drum 911 in accordance with the scanned laser beam. Then, the electrostatic latent images formed on the photosensitive drum 911 are developed by the developing unit 913 and visualized as toner images.

The sheet P is conveyed from any one of the cassettes 914 and 915, a manual pager feed unit 925, and a double-sided forming transfer path 924 to a transfer section composed of the photosensitive drum 911 and the transfer charger 916. In this transfer section, the visualized toner images on the photosensitive drum 911 are transferred to the sheet P. The sheet P having the transferred toner images is fixed in the fixing unit 917. The sheet P is then discharged to the finisher 2 by the discharge roller pair 104.

When the sheet P is discharged from the copying machine body 1, the surface having the formed toner images is directed downwardly (face down). For example, the sheet P passed through the fixing unit 917 is guided along a path 922 by a flapper 921. After the trailing end of the sheet has passed through the flapper 921, the sheet P is switched back and conveyed to the discharge roller pair 104 by the flapper 921 to be discharged from the copying machine body 1.

Thereby, the sheet P is discharged from the copying machine body 1 in the face down state. When the sheet P is discharged in the face down state, if images are formed sequentially from the head page, the page order can be coordinated when images are formed using the manuscript feeding unit 101. Also, the page order can be coordinated when images are formed in accordance with image data from a computer.

When images are formed on a hard sheet P conveyed from the manual pager feed unit 925, such as an OHP sheet, the sheet P is discharged from the copying machine body 1 by the discharge roller pair 104 without guiding the sheet P to the path 922 such that the surface having the formed toner images is directed upwardly (face up).

Furthermore, when images are formed on both sides of a sheet P, the sheet P is directly guided to the discharge roller pair 104 from the fixing unit 917. Immediately after the trailing end of the sheet P passed through the flapper 921, the sheet P is guided to the double-sided forming transfer path 924 from the path 922 by switching back the sheet P.

The sheet P discharged from the copying machine body 1 is to be brought into the finisher 2 which is a sheet processing apparatus for stitching sheets having formed images thereon in a bundle as well as for covering a sheet bundle with a book cover sheet.

Figure 1:
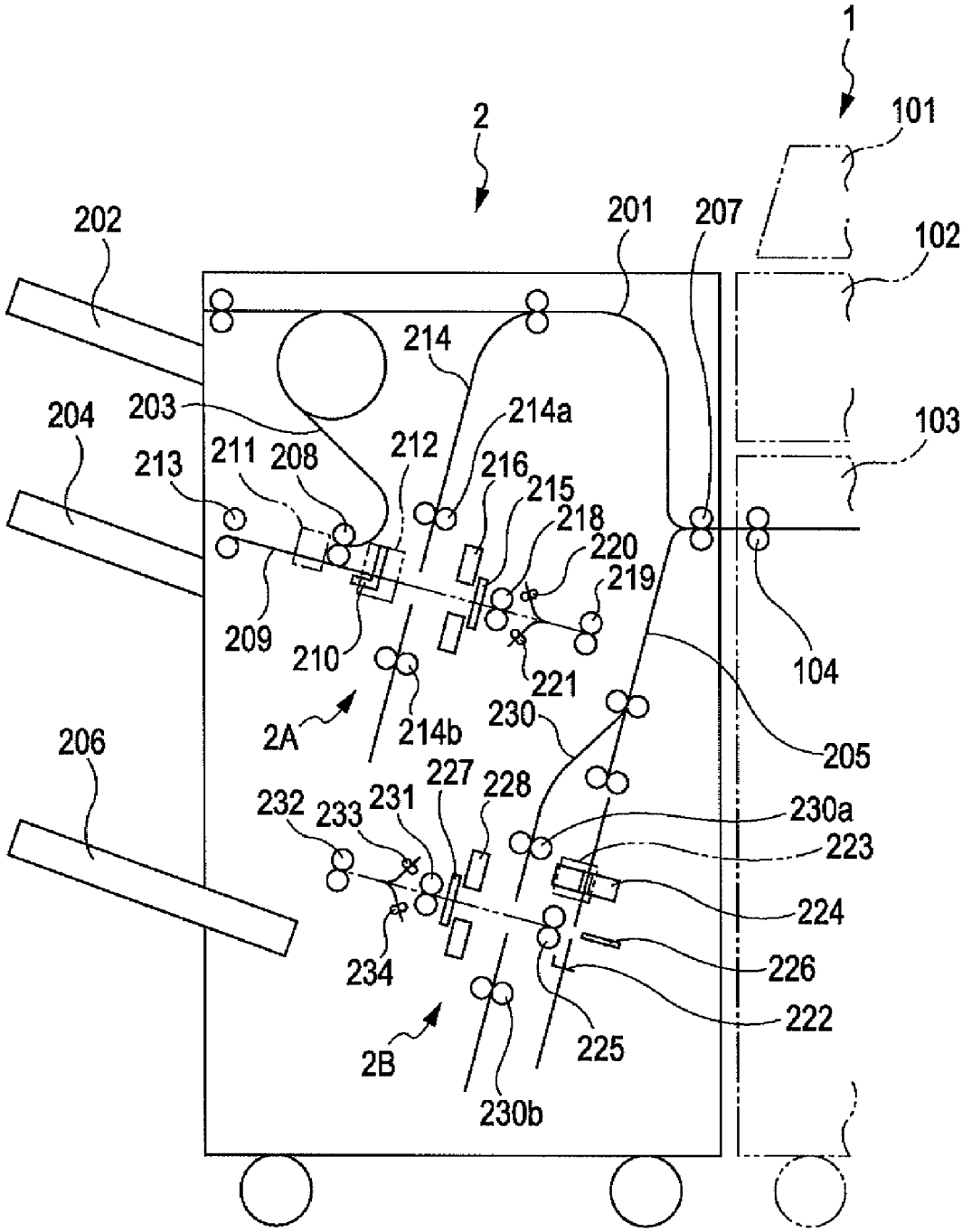
FIG. 1 is a sectional view of the main part of an image forming apparatus having a sheet processing apparatus.

FIG. 1 shows the finisher 2 according to the first embodiment. The finisher 2 is attached on the downstream side of the image forming apparatus body 103. Above the image forming apparatus body 103, the scanner 102 is arranged for producing an electrical image signal by reading image information of a manuscript as mentioned above. The image forming apparatus 103 forms images on a sheet on the basis of the image signal produced by the scanner 102. A digital copying machine is one example of such an image forming apparatus 103. The digital copying machine may be connected to a computer (not shown) so as to also have a printer function to form images on a sheet based on image information from the computer.

The image forming apparatus body 103 includes the discharge roller pair 104 for discharging sheets having formed images thereon one at a time outside the apparatus. The image information herein to be inputted into the image forming apparatus body 103 includes, for example, the manuscript image information read by the scanner 102 and/or image information fed from an external computer. The image forming apparatus body 103 brings the image information therein sequentially from a first page to the last so as to form images on sheets in that order and discharge them. When multiple copies are required, the image information from a first page to the last is stored in an internal memory, and the image forming operation from a first page to the last is repeated the required number of times.

As shown in FIG. 1, the finisher 2 includes a first transfer path 201 for discharging and placing sheets discharged from the image forming apparatus body 103. It also includes a first loading tray 202. The finisher 2 also includes processing units capable of selectively stitching a sheet bundle made up of a plurality of sheets.

The finisher 2 according to the present embodiment includes a side-stitching processing unit 2A capable of stitching on one side of a sheet bundle and a saddle-stitching processing unit 2B capable of stitching on the center of a sheet bundle. The finisher 2 also includes a second transfer path 203 for transferring sheets, which are discharged from the image forming apparatus body 103 and to be side-stitched in bundles, and a second loading tray 204 for placing the resultant discharged sheet bundles thereon. The finisher 2 also includes a third transfer path 205 for transferring sheets, which are discharged from the image forming apparatus body 103 and to be saddle-stitched in bundles, and a third loading tray 206 for placing the resultant sheet bundles thereon.

The finisher 2 includes book cover transfer paths 214 and 230 for transferring book cover sheets for covering stitched sheet bundles. The book cover transfer path 214 for the side-stitching processing unit 2A is a branch of the first transfer path 201. The book cover transfer path 230 for the saddle-stitching processing unit 2B is a branch of the third transfer path 205. The book cover transfer path 214 for the side-stitching processing unit 2A is provided with a first book-cover transfer roller pair 214*a* and a second book-cover transfer roller pair 214*b* for transferring book cover sheets. Similarly, the book cover transfer path 230 for the saddle-stitching processing unit 2B is provided with a first book cover transfer roller pair 230*a* and a second book cover transfer roller pair 230*b* for transferring book cover sheets.

Figure 2:
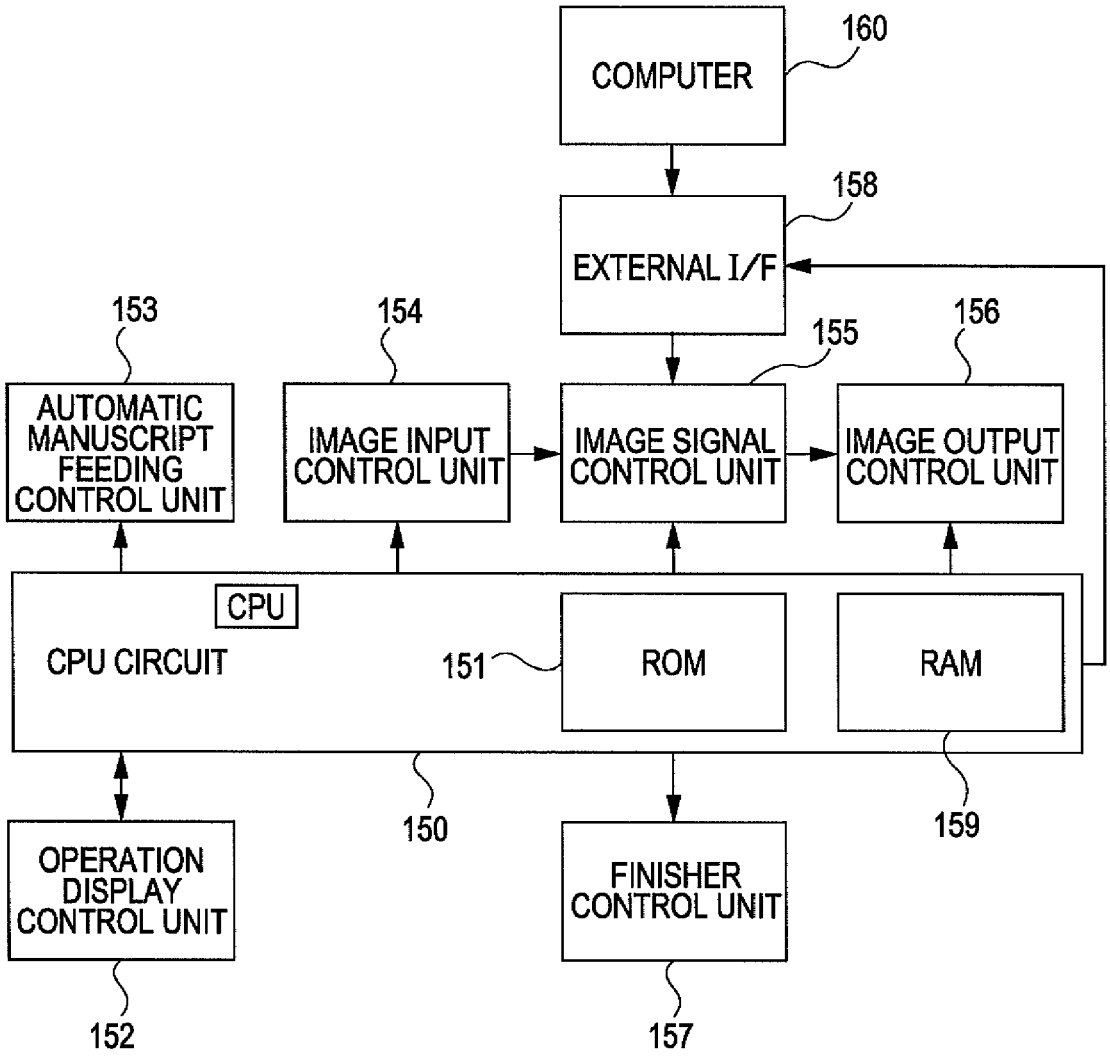
FIG. 2 is a block diagram of a control system of the sheet processing apparatus and the image forming apparatus.

FIG. 2 is a block diagram of a copying machine body 1 and the finisher 2. Referring to FIG. 2, a CPU circuit 150 including a CPU (central processing unit) controls the following control units 153 to 158 in accordance with control programs stored in an ROM 151 and settings of the operation display unit 400. The units to be controlled by the CPU circuit 150 include a manuscript feeding control unit 153, an image input control unit 154, an image signal control unit 155, an image output control unit 156, a finisher control unit 157, and an external I/F 158.

The manuscript feeding control unit 153 controls the manuscript feeding unit 101; the image input control unit 154 the scanner 102; the image output control unit 156 the image forming apparatus body 103; and the finisher control unit 157 the finisher 2. An operation control unit 157 controls the operation display unit 400. The operation display unit 400 outputs the key signal corresponding to a key operation by a user as well as displaying the information corresponding to a signal from the CPU circuit 150.

The RAM 159 is used as a region for temporarily storing control data and as an operation region for control computation. The external I/F 158 is an interface between the copying machine body 1 and an external computer 160, and outputs the image data to the image signal control unit 155 by developing print data from the external computer 160 into bit map images. The image input control unit 154 outputs manuscript images read by an image sensor (not shown) to the image signal control unit 155. The image output control unit 156 outputs image data from the image signal control unit 155 to an exposure control unit (not shown).

(During Selecting Side Stitching)

The case when side stitching processing is selected in the operation display unit 400 will now be described. If the side stitching processing is selected, a sheet conveyed to an inlet roller pair 207 in FIG. 1 is guided to the second transfer path 203 via the first transfer path 201 with a switching flapper (not shown). That is, the sheet is led to the side-stitching processing unit 2A.

The sheet conveyed to the second transfer path 203 is then stacked onto a processing tray 209 by a discharge roller pair 208. The processing tray 209 is inclined by a predetermined angle to the horizon so that the sheet abuts a sheet trailing-end restriction member 210 arranged at an end of the processing tray 209. The sheet, which has abutted the sheet trailing-end restriction member 210, is aligned in the width direction of the sheet by a pair of aligning plates, which are aligning members in the width direction of the sheet. When this operation is repeated the required number of times for the set number of sheets, stapling is performed on a trailing edge portion of a sheet bundle by a stapler 212 which is a side stitching processing unit, so that the sheet bundle is book-bound.

Then, the sheet bundle is pressurized by a bundle transfer roller pair 213 and discharged onto the second loading tray 204 by the rotation of the bundle transfer roller pair 213.

The sheet processing apparatus 2 according to the embodiment is configured so that a sheet bundle composed of stacked and aligned sheets can be selectively discharged directly onto the second loading tray 204 without stitching the sheet bundle.

Side Stitching and Book-Sheet Covering Mode

Now, with reference to FIGS. 3A to 4C, a case where side stitching processing and book-sheet covering mode are selected in the operation display unit 400 will be described. First, a sheet bundle S bound by stitching in the same manner as that described above is placed onto the processing tray 209.

Then, the sheet bundle S is conveyed in a direction opposite to the second loading tray 204 by the removal of the sheet trailing-end restriction member 210 and the reverse rotation of the bundle transfer roller pair 213, such that the rear end (spine) of the sheet bundle S is forwardly directed. The spine of the sheet bundle herein is the edge portion stapled by the stapler 212.

Figure 3A:
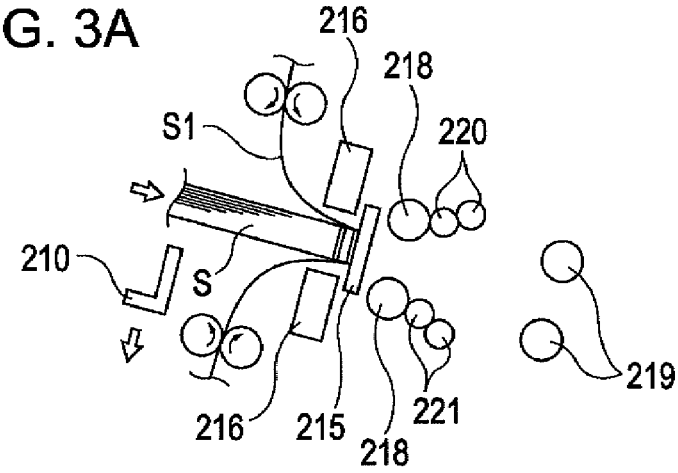
FIG. 3 is a partial sectional view of a side stitching part of the sheet processing apparatus.

Downstream in the direction in which the sheet bundle S is conveyed, the book cover transfer path 214, which is a branch of the first transfer path 201, is arranged in a direction substantially perpendicular to the conveying direction of the sheet bundle S. Along the book cover transfer path 214, a book cover sheet S1 with a dimension equal to or larger than that of the sheet bundle S is conveyed. More specifically, before the sheet bundle S is conveyed, the book cover sheet S1 with substantially the same width as that of the sheet bundle S and a length in the conveying direction approximately twice that of the sheet bundle S is conveyed to a predetermined position along the book cover transfer path 214. Hence, as shown in FIG. 3A, the sheet bundle S abuts approximately the center of the book cover sheet S1 so as to pressurize it. The book cover sheet S1 is folded along substantially its center with the edge of the sheet bundle S. The sheet bundle S is conveyed, while folding the book cover sheet S1, to a spine flattening processing unit for flattening the spine of the sheet bundle S. The book cover sheet S1 (waiting at a predetermined position in the book cover transfer path 214 before being folded by the sheet bundle) has been conveyed from the image forming apparatus body 103, where images have been formed on the book cover sheet S1.

The spine flattening processing unit includes a stopper 215, a clamp member 216, and a forming roller 217. The stopper 215 defines the position of the back of the book cover sheet S1 and the sheet bundle S covered with the book cover sheet S1. The clamp member 216 clamps the vicinity of the back governed by the stopper 215. The forming roller 217 abuts the back clamped with the clamp member 216 so as to form the book cover sheet portion corresponding to the spine of the sheet bundle in a spine shape by moving along the back while pressurizing the spine.

Hence, as shown in FIG. 3A, the sheet bundle S abuts approximately the center of the book cover sheet S1 so as to be conveyed until the leading edge of the sheet bundle S, which will be the spine, abuts the stopper 215 while folding back the book cover sheet S1 along approximately its center line.

Figure 3B:
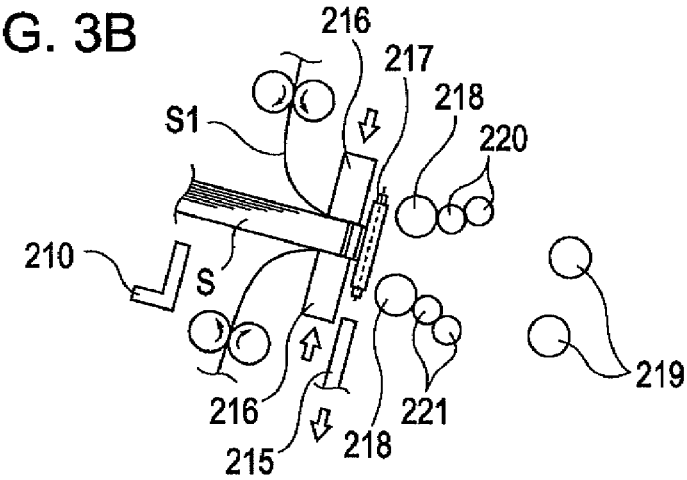

After abutting the stopper 215, the leading edge portion of the book cover sheet S1 is clamped with the clamp member 216. At this point the book cover sheet S1 is sandwiched between the sheet bundle S and the stopper 215 and clamp member 216. Then, as shown in FIG. 3B, the stopper 215 is removed from the sheet bundle S and the book cover sheet S1, and the forming roller 217 scans the back of the sheet bundle S and the book cover sheet S1 in a direction into and out of the plane of the drawing. The back of the book cover sheet S1, which is curved in a roughly U shape, is flattened in a shape parallel with the spine of the sheet bundle S by the forming roller 217, squaring the spine (spine flattening processing). As apparent from the above-description, the back of the book cover sheet S1 corresponds to the portion of the book cover sheet S1 folded by the conveyed sheet bundle.

By the spine flattening processing, the visibility of characters and pictures recoded on the back of the book cover sheet S1 is improved. Also, the contact between the back of the book cover sheet S1 and the spine of the sheet bundle S covered with the book cover sheet S1 is improved. A product with a more attractive appearance can be obtained with a smaller clearance between the book cover sheet S1 and the sheet bundle S.

In addition, the finisher 2 according to the embodiment is selectively configured so as to be able to proceed to a subsequent process without performing the flattening when the number of sheets constituting a sheet bundle S is small, in which case the spine flattening processing is unnecessary.

Figure 3C:
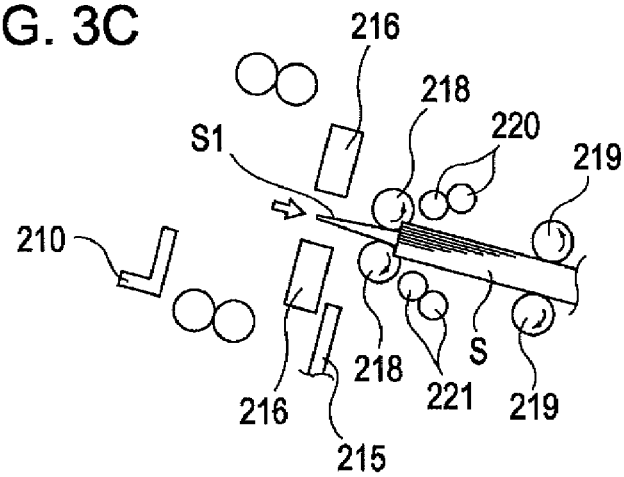

After the back side (spine) is squared, as shown in FIG. 3C, the clamp member 216 is retracted so as to continue the conveying the book cover sheet S1 and the sheet bundle S covered with the book cover sheet S1. After the leading end of the sheet bundle S arrives at the nip of a creasing/folding roller pair 218 constituting the creasing/folding processing unit and the nip of a transfer roller pair 219 arranged downstream from the creasing roller pair 218, the book cover sheet S1 and the sheet bundle S covered with the book cover sheet S1 are conveyed by the pressurizing and rotation of the roller pairs 218 and 219. When the leading edge of the sheet bundle S passes through the nip of the creasing/folding roller pair 218 made of a resilient (elastic) member, such as rubber and sponge, the book cover sheet S1 is pressurized on the leading edge of the sheet bundle S due to the elastic force of the creasing/folding roller pair 218. Thereby, the portions of the book cover sheet S1 which are folded back portions adjacent to the leading edges are folded or creased. That is, by the creasing/folding roller pair 218, the portions of the book cover sheet S1 adjacent to the fore edges are creased along the outer part of the leading edge of the sheet bundle S. The leading edge of the sheet bundle is the opened edge opposite to the spine.

The creased/folded cover sheet S1 and the sheet bundle S are folded back along the crease by a folding-back unit for folding-back a sheet along the crease to form flaps which are tucked in between the cover sheet and the sheet bundle, as shown in FIG. 4. The folding-back unit includes bending means for bending the book cover sheet S1 along the crease by deflecting the book cover sheet S1 in the vicinity of the crease and folding back roller pairs 220 and 221 for transferring the book cover sheet S1 by pinching the bent portions of the book cover sheet S1. The bending means includes two transfer roller pairs 218 and 219 arranged with the crease of the book cover sheet S1 therebetween. The two transfer roller pairs 218 and 219 are arranged rotatably in a direction opposite to each other so as to deflect the book cover sheet S1 with the crease therebetween.

Figure 4A:
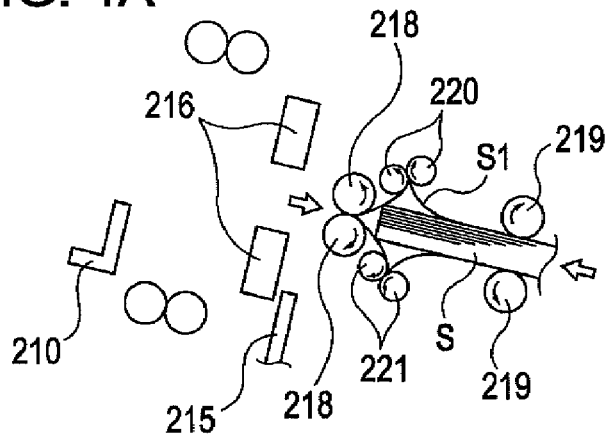
FIG. 4 is another partial sectional view of the side stitching part of the sheet processing apparatus.

That is, after the book cover sheet S1 was creased and the fore edge of the sheet bundle S passed through the creasing roller pair 218, the transfer roller pair 219 arranged on the downstream side is rotated in a direction opposite to that of the creasing roller pair 218. Then, as shown in FIG. 4A, the book cover sheet S1 starts being bent along the crease, and each bent portion of the book cover sheet S1 is conveyed to each nip of the rotating folding back roller pairs 220 and 221. That is, the transfer roller pairs 218 and 219 are rotated in a direction opposite to each other so that the creases produced by the creasing roller pair 218 enter nips of the folding back roller pairs 220 and 221.

Figure 4B:
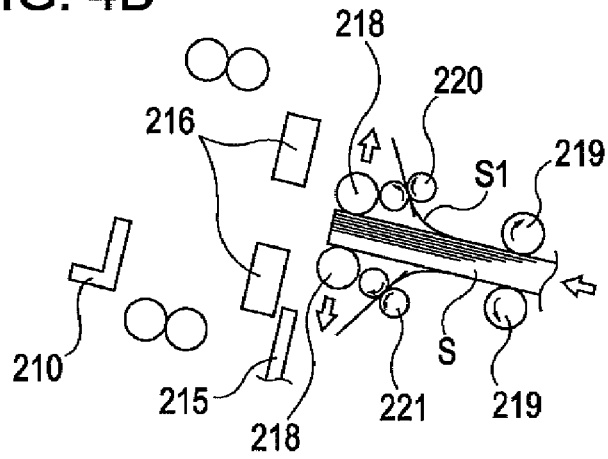

As shown in FIG. 4B, when the pressurizing force of the creasing roller pair 218 is relieved from the sheet bundle S as well as the book cover sheet S1, and the folding back roller pairs 220 and 221 and the transfer roller pair 219 are continued to rotate in the reverse direction (the conveying direction to the left in the drawings), the fore-edge portions of the book cover sheet S1 are folded back to form flaps.

Figure 4C:
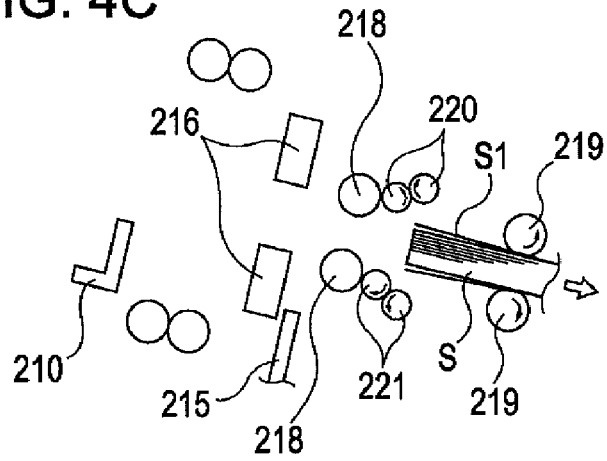

After the folding back of the fore-edge portions of the book cover sheet S1, as shown in FIG. 4C, the transfer roller pair 219 and the folding back roller pairs 220 and 221 are again rotated in the forward direction (the same direction as that of the creasing roller pair 218 or the conveying direction of the sheet bundle to the right in the drawings) until the book cover sheet S1 escapes from the nips of the folding back roller pairs 220 and 221, thereby completing the folding-back of the fore-edge portions of the book cover sheet S1.

The sheet bundle S having the book cover sheet S1 folded back in the above process is conveyed in the reverse direction with the folded-back fore edge portions as the leading part to the bundle transfer roller pair 213, and is discharged onto the second loading tray 204 by the pressurizing and rotation of the bundle transfer roller pair 213.

As described above, according to the embodiment, the side-stitched sheet bundle S can be covered with the book cover sheet S1 without increasing product cost, apparatus size, and operation complexity. Thereby, a resulting product with attractive appearance and no staple wire exposed on the surface can be obtained. By recording characters and pictures on the book cover sheet, a spine can be formed, further improving the appearance of the resulting product.

The flattening and squaring can be executed on the resulting side-stitched sheet bundle covered with the book cover sheet. Hence, the visibility of the characters and pictures recorded on the spine is improved and the broadening of the bundle is also decreased, thereby obtaining a resulting product with further attractive appearance. The contact between the back portion of the book cover sheet S1 and that of the sheet bundle S covered with the book cover sheet S1 is also improved. In the creasing and folding-back of the fore edge portion of the book cover sheet, which are back end steps of the back flattening process, a resulting product with an attractive appearance can also be obtained with a smaller clearance and misalignment between the book cover sheet and the sheet bundle.

(During Selecting Saddle Stitching)

Next, the case where the saddle stitching processing is selected in the operation display unit 400 will be described. If the saddle stitching processing is selected, as shown in FIG. 1, a sheet conveyed to the inlet roller pair 207 is guided to the third transfer path 205 by a switching flapper (not shown). That is, the sheet is led to the saddle-stitching processing unit 2B.

The leading end of the sheet led to the saddle-stitching processing unit 2B abuts a stopper 222 so as to be stacked. Then, the sheet is aligned in the width direction by an aligning plate pair 223, which is an aligning member in the sheet width direction. When this operation is repeated for the set number of sheets, the stapling is performed on a roughly center portion in the conveying direction of a sheet bundle by a stapler 224 which is a saddle stitching processing unit, so that the sheet bundle is book-bound.

Then, by moving the movable stopper 222 in the downstream direction by a predetermined distance determined according to the sheet size, the roughly center portion in the conveying direction of the sheet (the stapling portion) is conveyed to the vicinity of the nip of a folding roller pair 225. Then, by operating a prodding rod 226 toward the nip of the folding roller pair 225, the sheet bundle is folded back along the roughly center portion in the conveying direction. Namely, the saddle-stitching processing unit 2B includes a folding unit for folding back the sheet bundle on which the saddle stitching is selectively made. The folding unit is composed of the stopper 222, the folding roller pair 225, and the prodding member 226. According to the embodiment, the folding unit also serves as a conveying member for conveying the sheet bundle.

Figure 5A:
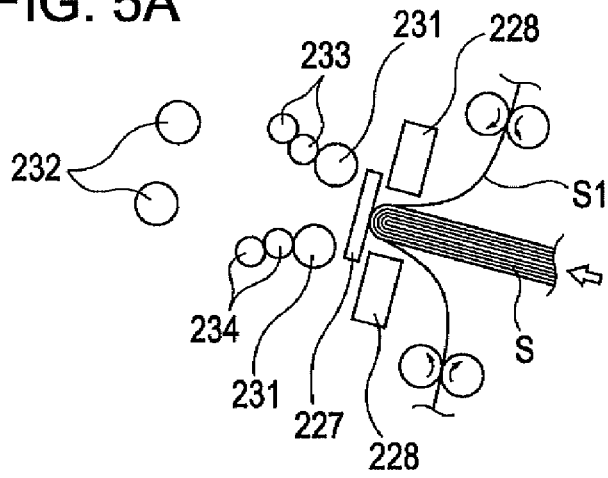
FIG. 5 is a partial sectional view of a saddle stitching part of the sheet processing apparatus.

The saddle-stitched and folded-back sheet bundle S, S1 is conveyed until the leading end, which will become a back of the sheet bundle S, S1 abuts a stopper 227 (see FIG. 5A). The back of the sheet bundle herein is the portion on which stabling is made by the stapler 224 as well as the end along which the sheet bundle is folded by the folding roller pair 225.

After abutting the stopper 227, the leading end of the sheet bundle S, S1 is clamped by a clamping member 228. Then, the stopper 227 is removed from the sheet bundle and a forming roller 229 (see FIG. 5B) is moved along the back of the sheet bundle in a direction into and out of the plane of the drawing. Then, the back of the sheet bundle, which is curved in a roughly U shape, is flattened, squaring the spine.

After the spine is squared, the sheet bundle is further conveyed by retracting the clamping member 228, and is discharged onto the third loading tray 206.

The finisher 2 according to the embodiment is configured so that a stacked and aligned sheet bundle can also be selectively discharged onto the third loading tray 206 after only folding back the sheet bundle without stapling it. Also, a folded and stitched or unstitched sheet bundle may be selectively discharged onto the third loading tray 206 without back flattening the sheet bundle.

Selecting Saddle Stitching and Book-Sheet Covering Mode

With reference to FIGS. 5A to 6C, the case where the saddle stitching processing and the book-sheet covering mode are selected in the operation display unit 400 will next be described. A sheet bundle S is first formed by the stapling and folding back processing as described above.

Then, on the downstream side of the folding roller pair 225, the book cover transfer path 230, which is a branch of the third transfer path 205, is arranged in a direction substantially perpendicular to the conveying direction of the sheet bundle S. Along the book cover transfer path 230, a book cover sheet S1 with a dimension larger than or equal to the sheet bundle S is conveyed. More specifically, along the book cover transfer path 230, the book cover sheet S1 with substantially the same width as that of the folded and stitched sheet bundle S and a length in the conveying direction over twice that of the sheet bundle S is conveyed to a predetermined position. Hence, as shown in FIG. 5A, the sheet bundle S abuts approximately the center of the book cover sheet S1 in the conveying direction so as to pressurize it. The book cover sheet S1 is folded along substantially its center line with the edge of the sheet bundle S. The sheet bundle S is conveyed, while folding the book cover sheet S1, to a spine flattening processing unit for flattening the spine of the sheet bundle S. The book cover sheet waiting at a predetermined position in the book cover transfer path 230 before being folded by the sheet bundle has been conveyed from the image forming apparatus body 103 where images have been formed on the book cover sheet.

The spine flattening processing unit includes the stopper 227, the clamping member 228, and the forming roller 229. The stopper 227 defines the position of the back of the book cover sheet S1 and the sheet bundle S covered with the book cover sheet S1. The clamp member 228 clamps the vicinity of the spine. The forming roller 229 abuts the back clamped with the clamp member 228 so as to flatten the spine of the sheet bundle and the book cover sheet portion corresponding to the spine of the sheet bundle by moving along the spine while pressurizing the spine.

Hence, as shown in FIG. 5A, the sheet bundle S abuts approximately the center of the book cover sheet S1 so as to be conveyed until the leading edge of the sheet bundle S, which will be the spine, abuts the stopper 227 while folding back the book cover sheet S1 along approximately its center line.

Figure 5B:
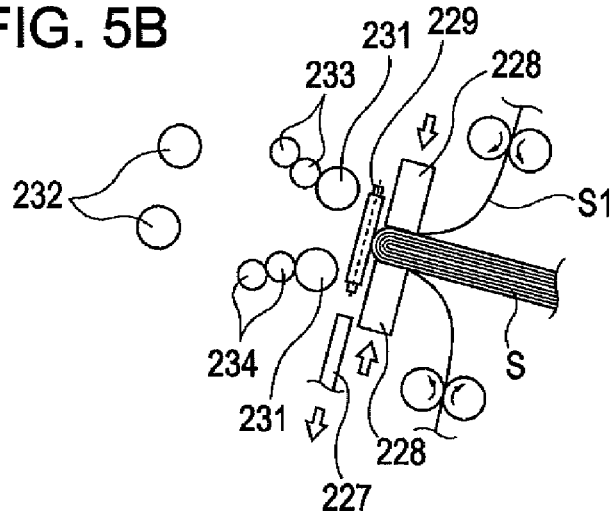

After abutting the stopper 227, the leading edge portion of the book cover sheet S1 is clamped with the clamp member 228 while the book cover sheet S1 surrounds the sheet bundle S. Then, as shown in FIG. 5B, the stopper 227 is evacuated from the sheet bundle S and the book cover sheet S1, and the forming roller 229 scans the back of the sheet bundle S and the book cover sheet S1 in front and rear directions of the drawing. Then, the back of the book cover sheet S1, which has been curved in a roughly U shape, is simultaneously flattened, squaring the spine.

By the spine flattening processing, the visibility of characters and pictures recorded on the back of the book cover sheet S1 is improved. Also, the contact between the back of the book cover sheet S1 and the spine of the sheet bundle S covered with the book cover sheet S1 is improved. In also the creasing of fore edges of the book cover sheet S1 and the folding-back process, which will be described later, a resulting product with an attractive appearance can be obtained with a smaller clearance between the book cover sheet S1 and the sheet bundle S. The spine of the sheet bundle S covered with the book cover sheet S1 is simultaneously flattened, so that the folding property of the spine of the sheet bundle S is also improved and the broadening of the bundle is also decreased, thereby obtaining a resulting product with further attractive appearance.

Figure 5C:
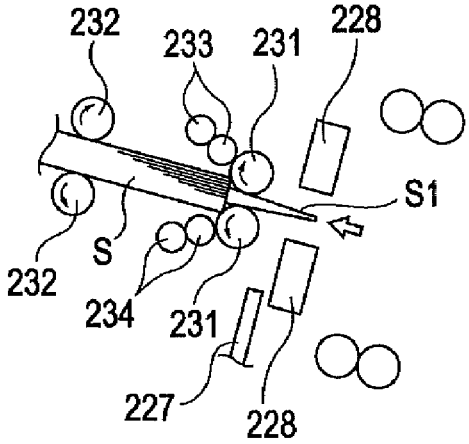

On the other hand, the finisher 2 according to the embodiment is selectively configured so as to be able to optionally proceed to a subsequent process without performing the flattening when the number of sheets constituting a sheet bundle S is small, so that the spine flattening processing is unnecessary. After the back side was squared, as shown in FIG. 5C, the clamp member 228 is retracted so as to continue the conveying the book cover sheet S1 and the sheet bundle S covered with the book cover sheet S1.

After the leading end of the sheet bundle S arrived at the nip of a creasing roller pair 231 constituting the creasing processing unit and the nip of a transfer roller pair 232 arranged downstream the creasing roller pair 231, the book cover sheet S1 and the sheet bundle S covered with the book cover sheet S1 are conveyed by the pressurizing and rotation of the roller pairs 231 and 232. When the fore edge of the sheet bundle S passes through the nip of the creasing roller pair 227 made of an elastic member, such as rubber and sponge, the book cover sheet S1 is pressurized on the fore edge of the sheet bundle S due to the elastic force of the creasing roller pair 227. Thereby, the portions of the book cover sheet S1 where are folding back portions adjacent to the fore edges are creased. That is, by the creasing roller pair 227, the portions of the book cover sheet S1 adjacent to the leading edges are creased along the outer shape of the fore edge of the sheet bundle S.

The creased cover sheet S1 and the sheet bundle S are folded back along the crease by a folding-back unit for folding-back a sheet along the crease to form flaps. The folding back unit includes bending means for bending the book cover sheet S1 along the crease by deflecting the book cover sheet S1 in the vicinity of the crease and folding back roller pairs 233 and 234 for transferring the book cover sheet S1 by pinching the bent portions of the book cover sheet S1. The bending means includes two transfer roller pairs 231 and 232 arranged with the crease of the book cover sheet S1 therebetween. The two transfer roller pairs 231 and 232 are arranged rotatably in a direction opposite to each other so as to deflect the book cover sheet S1 with the crease therebetween.

Figure 6A:
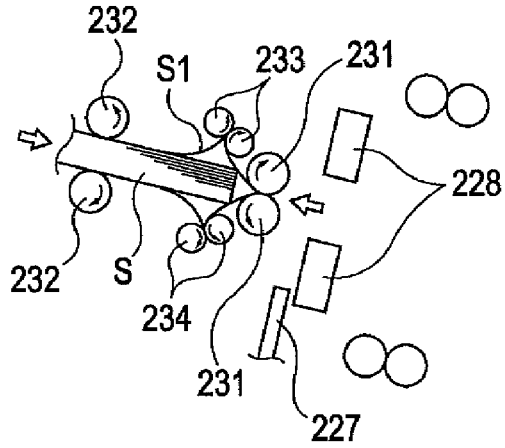
FIG. 6 is another partial sectional view of the saddle stitching part of the sheet processing apparatus.

Hence, after the book cover sheet S1 was creased and the fore edge of the sheet bundle S passed through the creasing roller pair 231, the transfer roller pair 232 arranged on the downstream side is rotated in a direction opposite to that of the creasing roller pair 231. Then, as shown in FIG. 6A, the book cover sheet S1 starts being bent along the crease, and each bent portion of the book cover sheet S1 is conveyed to each nip of the rotating folding back roller pairs 233 and 234.

Figure 6B:
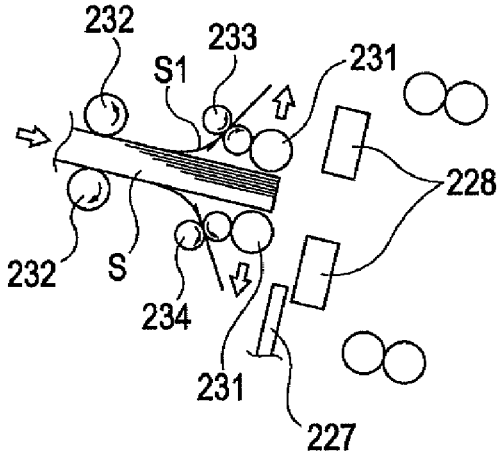

As shown in FIG. 6B, when the pressurizing force of the creasing roller pair 231 is relieved from the sheet bundle S as well as the book cover sheet S1 and the folding back roller pairs 233 and 234 and the transfer roller pair 232 are continued to rotate, the fore-edge portions of the book cover sheet S1 are folded back to form flaps or folded portions.

Figure 6C:
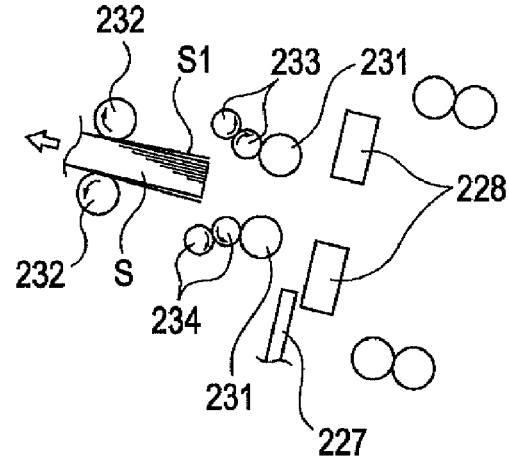

After the folding back of the fore-edge portions of the book cover sheet S1, as shown in FIG. 6C, the transfer roller pair 232 and the folding back roller pairs 233 and 234 are again rotated in the forward direction (the same direction as that of the creasing roller pair) until the book cover sheet S1 escapes from the nips of the folding back roller pairs 233 and 234, thereby completing the folding-back of the fore-edge portions of the book cover sheet S1.

The sheet bundle S having the book cover sheet S1 folded back in the above process is discharged onto the third loading tray 206 by the rotation of the transfer roller pair 232.

The processing operations of the components of the finisher 2 are controlled by a finisher control unit 152.

As described above, according to the embodiment, the saddle-stitched sheet bundle S can be covered with the book cover sheet S1 without increasing in product cost, apparatus size, and operation complexity. Thereby, a resulting product with further attractive appearance and no staple wire exposed on the surface can be obtained. By recording characters and pictures on the book cover sheet, a spine can be formed, further improving the appearance of the resulting product.

The flattening and squaring can be executed on the resulting saddle-stitched sheet bundle covered with the book cover sheet. Hence, the visibility of the characters and pictures recorded on the spine is improved and the broadening of the bundle is also decreased, thereby obtaining a resulting product with an attractive appearance. The contact in the back portion between the book cover sheet S1 and the sheet bundle S covered with the book cover sheet S1 is also improved. In the creasing and folding-back of the fore edge portion of the book cover sheet, which are back end steps of the back flattening process, a resulting product with an attractive appearance can also be obtained with a smaller clearance and misalignment between the book cover sheet and the sheet bundle.

Other Embodiments

Figure 8:
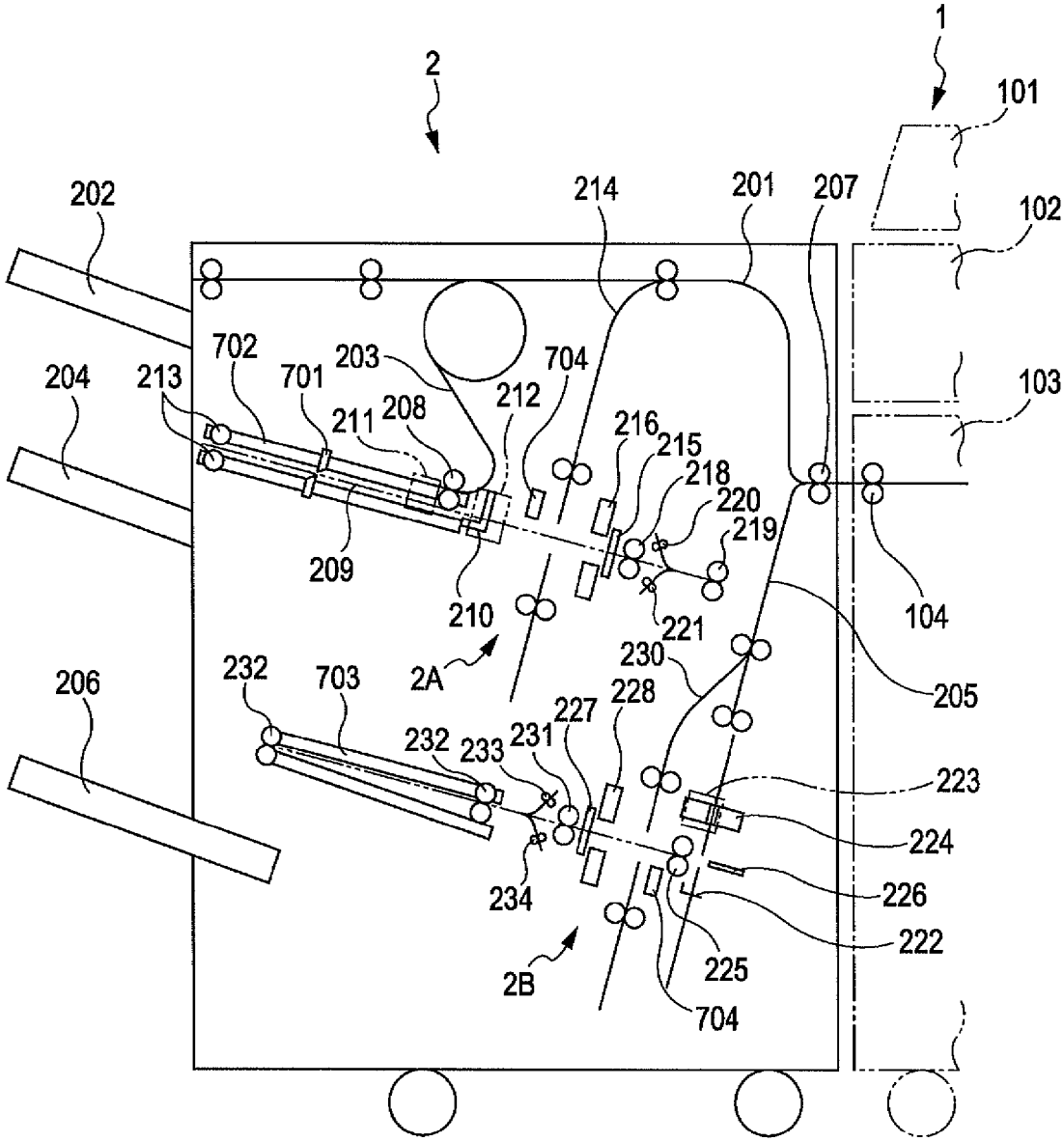
FIG. 8 is a sectional view of a sheet processing apparatus according to a further embodiment.

FIG. 8 is a sectional view of a finisher according to another embodiment. According to the embodiment described above, the cover sheet is attached to the book-bound sheet bundle without post processing; however, according to this embodiment, post processing is performed.

There is provided a fore-edge cutter 701 for cutting a fore edge portion at the trailing end of the sheet bundle as a fore-edge cutting unit. The cutting processing by the fore-edge cutter 701 is executed prior to the creasing processing of the cover sheet by the creasing roller pair 218. According to the embodiment shown in FIG. 7, after the end portion of the sheet bundle is stitched by the stapler 212, the cutting processing is executed by the fore-edge cutter 701. By such an arrangement, even when sheets used for a sheet bundle have variations in size, or the sheet bundle has misalignments, a resulting product with attractive appearance can be obtained by means of the cutting processing. Also, the cover sheet is creased and folded back along the fore edge cut to an equal length, thus a resulting product with further attractive appearance due to aligned fore edges of the sheet bundle including the cover sheet can be obtained.

Furthermore, according to the embodiment, edge cutter pairs 702 and 703 are provided for simultaneously cutting two edges (top-edge and bottom-edge) of the sheet bundle perpendicular to the spine of the sheet bundle. The cutting processing is executed by the edge cutter pairs 702 and 703 after the folding back processing by the folding back unit. That is, the edge cutter pair 702 provided in the side-stitching processing unit 2A simultaneously cuts the top-edge and the bottom-edge after the sheet bundle covered with the cover sheet, which has finished the creasing processing by the creasing roller pair 218 and the folding back along the crease by the folding back roller pairs 220 and 221, is conveyed to the downstream side (toward the second loading tray 204). Similarly, the edge cutter pair 703 provided in the saddle-stitching processing unit 2B simultaneously cuts the top-edge and the bottom-edge after the sheet bundle covered with the cover sheet is conveyed to the downstream side (toward the third loading tray 206).

With such an apparatus, even when sheets used for a sheet bundle and a cover sheet have variations in size, a resulting product with an attractive appearance due to the more finely aligned top-edge and bottom-edge can be obtained. Also, even when the sheet bundle and the cover sheet have misalignments or misalignments are generated due to the creasing or the folding back of the cover sheet, a resulting product with an attractive appearance due to the more finely aligned top-edge and low-edge can be obtained in the same manner. Even when the cover sheet with the same width is absent from sheets used for the sheet bundle, the sheet bundle can be aligned by cutting it in conformity with the size of the sheet bundle using the cover sheet with a different width. Thereby, the degree of freedom in selecting the sheet size is increased, improving work efficiency.

Furthermore, according to the embodiment shown in FIG. 8, a bonding unit 704 is provided for bonding the sheet bundle to the cover sheet. The bonding processing is executed by the bonding unit 704 prior to the abutment of the end to the sheet bundle to the cover sheet. Specifically, in the process prior to the abutment of the sheet bundle to the cover sheet, the bonding unit 704 applies an adhesive on the spine of the sheet bundle. According to the embodiment, the spine of the sheet bundle is coated with the adhesive; alternatively, or in addition, a fore edge portion of the cover sheet may be coated with the adhesive.

By such a structure, even when a coefficient of friction between the sheet bundle and the cover sheet has variations, the displacement during conveying can be securely reduced, a resulting product with a more attractive appearance due to the more stable conveying can be obtained. When the fore edge portion of the cover sheet is folded back, the cover sheet can be securely folded back by catching up only one front-side sheet of the sheet bundle, enabling a resulting product to be obtained with attractive appearance and higher quality.

According to the embodiments described above, the processing apparatus for selectively performing stitching on a sheet bundle composed of a plurality of sheets so as to book-bind the sheet bundle includes both the side-stitching processing unit and the saddle-stitching processing unit; however the present invention is not limited to this. The processing apparatus may include either one of the side-stitching processing unit and the saddle-stitching processing unit. The processing apparatus is also not limited to the side-stitching processing unit and the saddle-stitching processing unit. The stitching units for performing stitching on a sheet bundle composed of a plurality of sheets have been exemplified; alternatively, the sheet bundle may be book-bound by a method for binding the sheet bundle by bonding the end of the sheet bundle with an adhesive and a method for binding the sheet bundle by sewing the end of the sheet bundle with thread.

According to the embodiments described above, the copying machine has been exemplified as the image forming apparatus; however, the present invention is not limited to this, so that it may be other image forming apparatuses, such as a printer and a facsimile machine or a compound machine having these assorted functions. By applying the present invention to a sheet processing apparatus used for these image forming apparatuses, the same effect can be obtained.

According to the embodiments described above, a sheet processing apparatus detachably arranged in the image forming apparatus has been exemplified; however, the present invention is not limited to this, so that it may be a sheet processing apparatus integrally provided in the image forming apparatus. By applying the present invention to the sheet processing apparatus, the same effect can be obtained.

The book-binding in this application means that a sheet bundle coordinated in page order is bound without dissipation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2005-356550 filed Dec. 9, 2005, which is hereby incorporated by reference herein in its entirety.

What is claimed is:

1. A sheet processing apparatus which covers a sheet bundle with a cover sheet to wrap around a spine edge of the sheet bundle and extends beyond an edge opposite the spine edge of the sheet bundle, comprising:

a creasing unit configured to make a crease along an outer portion of the cover sheet adjacent the opposite edge, the creasing unit includes a resilient member which pressurizes the cover sheet on the edge of the sheet bundle to form the crease, the resilient member includes an elastic roller pair which conveys the cover sheet covering the sheet bundle; and a folding-back unit configured to fold the end portion of the cover sheet along the crease made by the creasing unit towards the sheet bundle to provide two folded portions between the cover sheet and the sheet bundle.

2. A sheet processing apparatus which covers a sheet bundle with a cover sheet to wrap around a spine edge of the sheet bundle and extends beyond an edge opposite the spine edge of the sheet bundle, comprising:

a creasing unit configured to make a crease along an outer portion of the cover sheet adjacent the opposite edge, the creasing unit includes a resilient member which pressurizes the cover sheet on the edge of the sheet bundle to form the crease; and a folding-back unit configured to fold the end portion of the cover sheet along the crease made by the creasing unit towards the sheet bundle to provide two folded portions between the cover sheet and the sheet bundle, wherein the resilient member includes an elastic roller pair which conveys the cover sheet covering the sheet bundle, and the folding-back unit includes a folding-back roller pair which folds back the cover sheet by pinching the crease of the cover sheet so as to convey the cover sheet, and wherein the elastic roller pair rotates to convey the crease toward the nip of the folding-back roller pair while making the crease on the cover sheet.

3. A sheet processing apparatus which covers a sheet bundle with a cover sheet to wrap around a spine edge of the sheet bundle and extends beyond an edge opposite the spine edge of the sheet bundle, comprising:

a creasing unit configured to make a crease along an outer portion of the cover sheet adjacent the opposite edge; and a folding-back unit configured to fold the end portion of the cover sheet along the crease made by the creasing unit towards the sheet bundle to provide two folded portions between the cover sheet and the sheet bundle, the folding-back unit includes a folding-back roller pair which folds back the cover sheet by pinching the crease of the cover sheet to convey the cover sheet.

4. The apparatus according to claim 3, further comprising two transfer roller pairs arranged so as to pinch the crease of the cover sheet, wherein any of the transfer roller pairs rotates in a direction to the crease so that the two transfer roller pairs allow the crease to enter the nip of the folding-back roller pair by deflecting the cover sheet.

5. The apparatus according to claim 4, wherein one of the two transfer roller pairs constitutes the creasing unit which makes the crease on the cover sheet.

* * * * *